US009605500B2

(12) United States Patent
Yajure et al.

(10) Patent No.: US 9,605,500 B2
(45) Date of Patent: Mar. 28, 2017

(54) SYSTEM AND METHOD FOR MANAGING DRILLING FLUID

(71) Applicant: Tesco Corporation, Houston, TX (US)

(72) Inventors: Edgar Fernando Yajure, Calgary (CA); Ryan Thomas Bowley, Calgary (CA)

(73) Assignee: TESCO CORPORATION, Houston, TX (US)

( * ) Notice: Subject to any disclaimer, the term of this patent is extended or adjusted under 35 U.S.C. 154(b) by 410 days.

(21) Appl. No.: 14/258,827

(22) Filed: Apr. 22, 2014

(65) Prior Publication Data

US 2015/0300109 A1 Oct. 22, 2015

(51) Int. Cl.

| | |
|---|---|
| ***E21B 21/01*** | (2006.01) |
| ***E21B 21/08*** | (2006.01) |
| ***E21B 19/10*** | (2006.01) |
| ***E21B 21/10*** | (2006.01) |

(52) U.S. Cl.

CPC ..... *E21B 21/08* (2013.01); *E21B 19/10* (2013.01); *E21B 21/01* (2013.01); *E21B 21/106* (2013.01)

(58) Field of Classification Search

CPC .... E21B 19/16; E21B 21/01; E21B 2021/007; E21B 33/08

See application file for complete search history.

(56) References Cited

U.S. PATENT DOCUMENTS

| | | | | |
|---|---|---|---|---|
| 2,849,213 | A | 11/1953 | Failing | |
| 3,322,198 | A * | 5/1967 | McHenry | E21B 21/01 166/81.1 |
| 3,481,113 | A * | 12/1969 | Burnham, Sr. | B01D 3/101 159/3 |
| 6,474,418 | B2 * | 11/2002 | Miramon | E21B 33/08 166/377 |
| 2002/0070029 | A1 | 6/2002 | Miramon | |
| 2011/0265992 | A1 | 11/2011 | Pearson | |
| 2014/0238530 | A1 | 8/2014 | Holtby | |

OTHER PUBLICATIONS

PCT/US2015/027154 Internationai Search Report and Written Opinion dated Nov. 3, 2015.

* cited by examiner

*Primary Examiner* — David Andrews
(74) *Attorney, Agent, or Firm* — Fletcher Yoder, P.C.

(57) ABSTRACT

Present embodiments are directed to a drilling fluid management device. A containment structure of the drilling fluid management device is capable of engaging and at least partially creating a seal with a drillpipe element or drillpipe handling equipment. Further, a suction port structure of the drilling fluid management device extends from the containment structure and includes an opening into the containment structure, wherein the suction port structure is designed to couple with a drilling fluid transport feature.

19 Claims, 7 Drawing Sheets

SYSTEM AND METHOD FOR MANAGING DRILLING FLUID

BACKGROUND

Present embodiments relate generally to the field of drilling and processing of wells, and, more particularly, present embodiments relate to drilling fluid management systems and methods, which may be used to facilitate one or more of controlling, containing, and routing drilling fluid during coupling and decoupling of drillpipe elements as part of a drilling-related operation.

In conventional oil and gas operations, a drilling rig is used to drill a wellbore to a desired depth using a drill string, which includes drillpipe, drill collars and a bottom hole drilling assembly. During drilling, the drill string may be turned by a rotary table and kelly assembly or by a top drive to facilitate the act of drilling. As the drill string progresses down hole, additional drillpipe is added to the drill string.

During drilling of the well, the drilling rig may be used to insert joints or stands (e.g., multiple coupled joints) of drillpipe into the wellbore. Similarly, the drilling rig may be used to remove drillpipe from the wellbore. As an example, during insertion of drillpipe into the wellbore by a traditional operation, each drillpipe element (e.g., each joint or stand) is coupled to an attachment feature that is in turn lifted by a traveling block of the drilling rig such that the drillpipe element is positioned over the wellbore. An initial drillpipe element may be positioned in the wellbore and held in place by gripping devices near the rig floor, such as slips. Subsequent drillpipe elements may then be coupled to the existing drillpipe elements in the wellbore to continue formation of the drill string. Once attached, the drillpipe element and remaining drill string may be held in place by an elevator and released from the gripping devices (e.g., slips) such that the drill string can be lowered into the wellbore. Once the drill string is in place, the gripping devices can be reengaged to hold the drill string such that the elevator can be released and the process of attaching drillpipe elements can be started again. Similar procedures may be utilized for removing drillpipe from the wellbore.

During coupling and decoupling of certain drillpipe elements in traditional operations, drilling fluid (e.g., drilling mud) spills in the work area and/or circulation of drilling fluid is interrupted, which can cause undesirable results. It is now recognized that certain aspects of existing techniques for coupling and decoupling drillpipe elements during drilling or a drilling-related operations are inefficient. Accordingly, it is now recognized that it is desirable to provide improved systems and methods for facilitating such operations.

BRIEF DESCRIPTION OF THE DISCLOSURE

Certain embodiments commensurate in scope with the originally claimed subject matter are summarized below. These embodiments are not intended to limit the scope of the claims, but rather these embodiments are intended only to provide a brief summary of possible forms of the disclosed embodiments. Indeed, present embodiments may encompass a variety of forms that may be similar to or different from the embodiments set forth below.

Present embodiments include a system with a drilling fluid management device. A containment structure of the drilling fluid management device is configured to engage and at least partially create a seal with a drillpipe element or drillpipe handling equipment. A suction port structure of the drilling fluid management device extends from the containment structure and including an opening into the containment structure, wherein the suction port structure is configured to couple with a drilling fluid transport feature.

A method in accordance with present embodiments includes coupling a containment structure of a drilling fluid management device about a drillpipe element such that at least a partial seal is established between a lower end of the containment structure and the drillpipe element below a face of an opening of the drillpipe element. Further, the method includes applying a suction within the containment structure via a suction port structure of the drilling fluid management device that includes an opening into the containment structure. Additionally, the method includes transporting drilling fluid from within the drilling fluid management device to a drilling fluid retention tank from the suction port structure.

A system in accordance with present embodiments includes a drillpipe element and a drilling fluid management device. A containment structure of the drilling fluid management device is coupled about the drillpipe element. A suction port structure is coupled with the containment structure and includes an opening into the containment structure. A suction manifold is communicatively coupled with the suction port structure and includes a valve configured to seal the suction manifold away from the suction port structure. A venturi bank, including a plurality of venturis, is communicatively coupled with the suction manifold along a main flow path of each venturi and down stream of a constriction in each venturi. A drilling fluid pumping system is configured to pump drilling fluid through the main flow path of each venturi.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
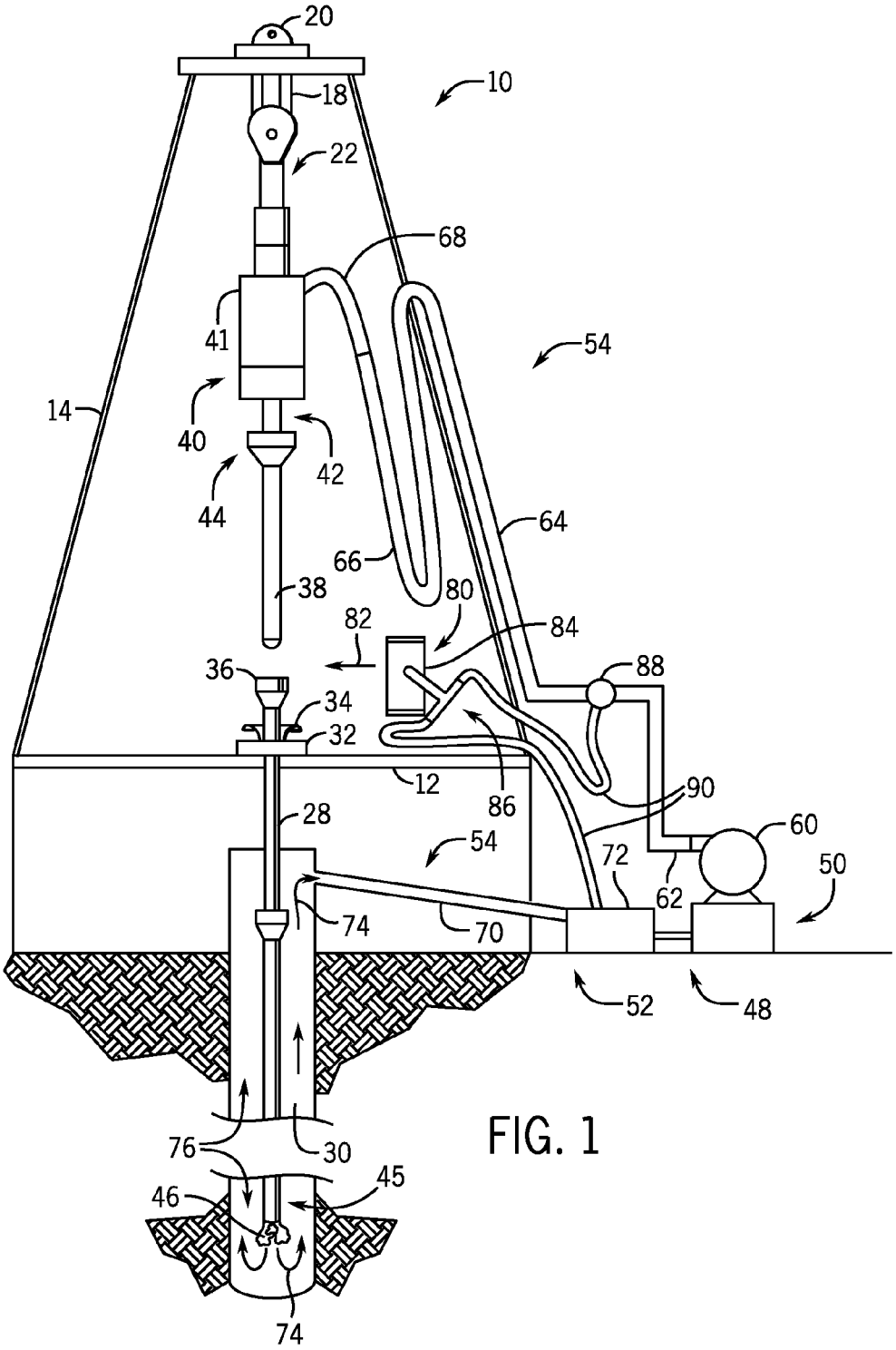
FIG. 1 is a schematic of a well being drilled in accordance with present techniques.

Present embodiments are directed to systems and methods that relate to managing the flow of drilling fluid through drillpipe handling equipment (e.g., pipe drive systems), drillpipe elements (e.g., joints or strings of drillpipe or casing tubular) and so forth during certain drilling-related operations (e.g., changing stands or tripping drillpipe out of a hole). For example, present embodiments include a drilling fluid management device that includes a containment structure and a suction port. The containment structure functions to engage a portion of a drillpipe element during coupling or decoupling of the drillpipe element and to retain an amount of drilling fluid therein. The suction port provides a pathway for the drilling fluid to escape the containment structure.

The drilling fluid management device facilitates continuous circulation of drilling fluid through associated drillpipe elements and/or handling equipment during associated coupling or decoupling without substantial spillage. Indeed, the drilling fluid management device may operate to control the spillage of drilling fluid typically associated with such operations by directing the drilling fluid through the suction port and out of the immediate work area via associated tubing, piping, or the like. In one example, a system in accordance with present embodiments may operate to apply a suction to the suction port such that drilling fluid that is within the containment structure is suctioned out and transported to a location for capturing the drilling fluid, which would have otherwise spilled out of a drillpipe element and onto the surrounding work space.

To better understand present embodiments, it may be useful to provide a discussion of the nature of certain drilling-related operations that are facilitated by present embodiments. To begin with, it may be useful to consider actions and features involved with the attachment and detachment of drillpipe elements. Each drillpipe element typically includes a pin end and a box end to facilitate coupling of multiple joints of drillpipe. When positioning and assembling drillpipe elements in the wellbore, a drillpipe element is typically inserted into the wellbore until only an upper end is exposed above the wellbore. This exposed portion may be referred to as a stump. At this point, slips are typically positioned about the stump near the rig floor to hold the drillpipe element in place. In some embodiments, the drilling fluid management device may be integral with or designed to operate in conjunction with such slips. With respect to the orientation of the stump, the box end is typically positioned facing upward ("box up") such that the pin end of subsequently inserted drillpipe with the pin facing downward ("pin down") can be coupled with the box end of the previously inserted drillpipe or stump to continue formation of the downhole string. Drillpipe being added may be gripped at a distal end by a pipe drive system and the opposite distal end may be stabbed into the box end of the stump. Next, the pipe drive system may be employed to make-up a coupling between the drillpipe being added and the stump. In some embodiments, the pipe drive system may incorporate the drilling fluid management device as an integral feature or an attachment. Once the newly added drillpipe is appropriately attached, the gripping member may be removed and the drill string lowered further into the wellbore using an elevator. This process continues until a desired length of the drill string is achieved. Similarly, a reverse process may be used during removal of a drill string from a wellbore.

As generally suggested above, during a process of installing or removing drillpipe elements, it may be desirable to continue circulation of fluids (e.g., drilling mud) through the associated drill string to avoid potential scenarios that have been associated with a lack of drilling fluid circulation. Indeed, it is now recognized that substantial interruptions of such circulation can have undesirable results. For example, some undesirable results of interrupted circulation include: causing downhole temperature excursions, allowing drilling cuttings to settle and provide obstructions to drilling, encouraging an environment that is conducive to stuck pipe incidents, causing formation damage, and so forth. However, while continuous circulation might limit such issues, there are also undesirable issues associated with continuous circulation during certain aspects of a drilling-related operation. For example, continuous circulation while tripping drillpipe out of the hole can result in substantial spillage of the drilling fluid, which may cause delays. Indeed, a stand of piping being tripped out of the hole may be full of drilling fluid and, when the bottom connection between this stand and the stump is removed, the column of drilling fluid may drain down and onto the surrounding workspace.

A pipe drive system in accordance with present techniques may be used to facilitate assembly and disassembly of drill strings while continuously circulating drilling fluid through the drill string. Specifically, in accordance with present embodiments, a pipe drive system (e.g., top drive or iron rough neck) may be integral with or otherwise employed with a drilling fluid management device that facilitates control of spillage of the drilling fluid during transition operations. Such a pipe drive system may be employed to engage and lift a drillpipe element (e.g., a drillpipe joint), align the drillpipe element with a drill string, stab a pin end of the drillpipe element into a box end of the drill string, engage the drill string, and apply torque to make-up a coupling between the drillpipe element and the drill string. Thus, a pipe drive system may be employed to extend the drill string. Similarly, the pipe drive system may be used to disassemble drillpipe elements from a drill string by applying reverse torque and lifting the drillpipe elements out of the engagement with the remaining drill string. It should be noted that torque may be applied using a top drive system, iron roughneck, or the like coupled to the pipe drive system, integral with the pipe drive system, or defining the pipe drive system. Further, in accordance with present embodiments, such coupling and decoupling operations may be performed while circulating drilling fluid through related drillpipe features because the drilling fluid management device is properly coupled to one or more of the drillpipe elements and operating to remove at least a substantial portion of drilling fluid that would otherwise spill onto the surrounding workspace. Indeed, present embodiments may facilitate performance of such functions without substantial spillage of the associated drilling fluid by capturing, within the containment structure, drilling fluid that flows out of the drillpipe elements and by transporting the captured drilling fluid to a desired location via the suction feature.

Turning now to the drawings, FIG. 1 is a schematic representation of a drilling rig 10 in the process of drilling a well in accordance with present techniques. While FIG. 1 represents a drilling process, present embodiments may also be utilized for tripping processes and so forth. In particular, present embodiments may be employed in procedures including assembly or disassembly of drillpipe elements, wherein it is desirable to provide an amount of fluid circulation through the drillpipe elements from a drillpipe handling system during assembly or disassembly procedures. Furthermore, present embodiments may be used to manage fluid circulation during drilling of the formation and for controlling levels of drilling fluid circulation.

In the illustrated embodiment, the drilling rig 10 features an elevated rig floor 12 and a derrick 14 extending above the rig floor 12. The drilling rig 10 may employ a hoisting system that facilitates hoisting various types of equipment and drillpipe above the rig floor 12. While all aspects of such a hoisting system are not shown, it may include a supply reel (not shown) that supplies drilling line 18 to a crown block 20 and traveling block 22 configured to hoist various types of equipment and drillpipe above the rig floor 12. The drilling line 18 is secured to a deadline tiedown anchor (now shown). Further, a drawworks (not shown) regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another drillpipe element or length of drillpipe 38 is in the process of being added.

The length of drillpipe 38 is held in place by a pipe drive system 40 that is hanging from the traveling block 22. In the illustrated embodiment, the pipe drive system 40 is holding the drillpipe 38 in alignment with the stump 36 to facilitate attachment of the drillpipe 38 to the stump 36. Specifically, the pipe drive system 40 of FIG. 1 represents a top drive 41, which features a quill 42 that is is engaged with a distal end 44 (box end) of the drillpipe 38 and operates to turn the drillpipe 38 for connecting or disconnecting purposes. In other words, the pipe drive system 40 of FIG. 1 includes the top drive system 41 configured to supply torque for making-up and unmaking a coupling between the drillpipe 38 and the stump 36.

The engagement between the pipe drive system 40 and the drillpipe 38 also facilitates circulation of drilling fluid (e.g., drilling mud) through the pipe drive system 40 into the drillpipe 38 and the drill string 28. This circulation of drilling fluid may facilitate drilling and advancement of the wellbore 30. Indeed, in order to advance the wellbore 30 to greater depths, the drill string 28 features a bottom hole assembly (BHA) 45, which includes a drill bit 46 for crushing or cutting rock away from a formation. The drilling fluid may be circulated through components of the drilling rig 10, including the drill bit 46, in order to remove cuttings and crushed rock from the wellbore 30. A fluid circulation system 48, which generally includes a driving mechanism 50, a retention area 52, and flow paths 54 (e.g., including the drill string 28, the top drive 41, and other features of the rig 10), may operate to control this circulation of the drilling fluid.

In the illustrated embodiment, the fluid circulation system 48 includes a mud pump 60, a discharge line 62, a stand pipe 64, a rotary hose 66, a gooseneck 68 leading into the top drive 41, a return line 70, a retention tank 72, and other aspects of the rig 10. In operation, the mud pump 60 provides the motivating force for circulation of the drilling fluid. Specifically, the mud pump 60 pumps drilling fluid through the discharge line 62, the stand pipe 64, the rotary hose 66, and the gooseneck 68 into the top drive 41. During standard circulation, from the top drive 41, the drilling fluid flows through the drill string 28 and the associated BHA 45 to exit into the wellbore 30 via the drill bit 46. As indicated by arrows 74, the drilling fluid is then pushed up toward the surface through an annulus 76 formed between the wellbore 30 and the drill string 28. As the drilling fluid proceeds up the annulus 76, it generally carries the rock cuttings and so forth with it to the surface. Once the drilling fluid reaches the surface, the return line 70 conveys the drilling fluid to the retention tank 72, which feeds the mud pump 60 after the cuttings have been separated and filtered from the mud. In some embodiments, a series of tanks and other components may be utilized to separate the cuttings from the drilling fluid before the drilling fluid is returned to the mud pump 60 to continue circulation.

In the embodiment illustrated in FIG. 1, the drillpipe 38 has not yet been coupled with the stump 36. If the drillpipe 38 were being removed, any drilling fluid still resident in the drill pipe 38 would spill onto the rig floor 12. Accordingly, present embodiments include a drilling fluid management device 80, which is depicted in FIG. 1 as being maneuvered into connection with the stump 36, as indicated by arrow 82. In some scenarios, the drilling fluid management device 80 would already be in position at the illustrated stage of operation. For example, in some embodiments, the drilling fluid management device 80 may be integral with the slips 34 or the pipe drive system 40 and already engaging the stump 36. However, for illustrative purposes, FIG. 1 shows and embodiment wherein the drilling fluid management device 80 is separate and in the process of being coupled to the stump 36. It should also be noted that, in some embodiments, the drilling fluid management device 80 may engage different features (e.g., the stump 36 alone, the stump and the drillpipe 38, the rotary table 32, the slips 34, the quill 42).

Specifically, as illustrated in FIG. 1, a body or containment structure 84 of the drilling fluid management device 80 is in the process of being clamped about the stump 36 to facilitate capturing the drilling fluid (e.g., at least a portion of the drilling fluid) being circulated or otherwise flowing out of the drillpipe 38. Further, the drilling fluid management device 80 includes a suction port structure 86 that facilitates transport of drilling fluid out of the containment structure 84 and away from the surrounding workspace. Specifically, in operation, the suction port structure 86 may receive drilling fluid into a portion of the suction port structure 86 that acts as a venturi, which may be described as a tube or passage between wider sections for exerting suction. The drilling fluid passing through the suction port structure 86 may be received from a diverter valve 88 disposed along the flow path out of the mud pump 60 and operable to divert the flow to a conduit 90, which is coupled with the drilling fluid management device 80. As the drilling fluid flows through a main flow path of the venturi portion of the suction port structure 86, a suction is generated inside of the containment structure 84, such that any drilling fluid therein will be pulled into the suction port structure 86 and joined with the drilling fluid flowing through the conduit 90. The conduit 90 extends from the suction port structure 86 to the retention tank 72. Accordingly, any drilling fluid passing through the conduit 90 may be returned to the pump 60 for further circulation. In other embodiments, different arrangements may be included. For example, the conduit 90 may expel the drilling fluid into a tank separate from the circulation system 48 or at a different location within the circulation system 48. Further, in some embodiments, the containment structure 86 is coupled with a different type of vacuum source via the suction port structure 86.

Figure 2:
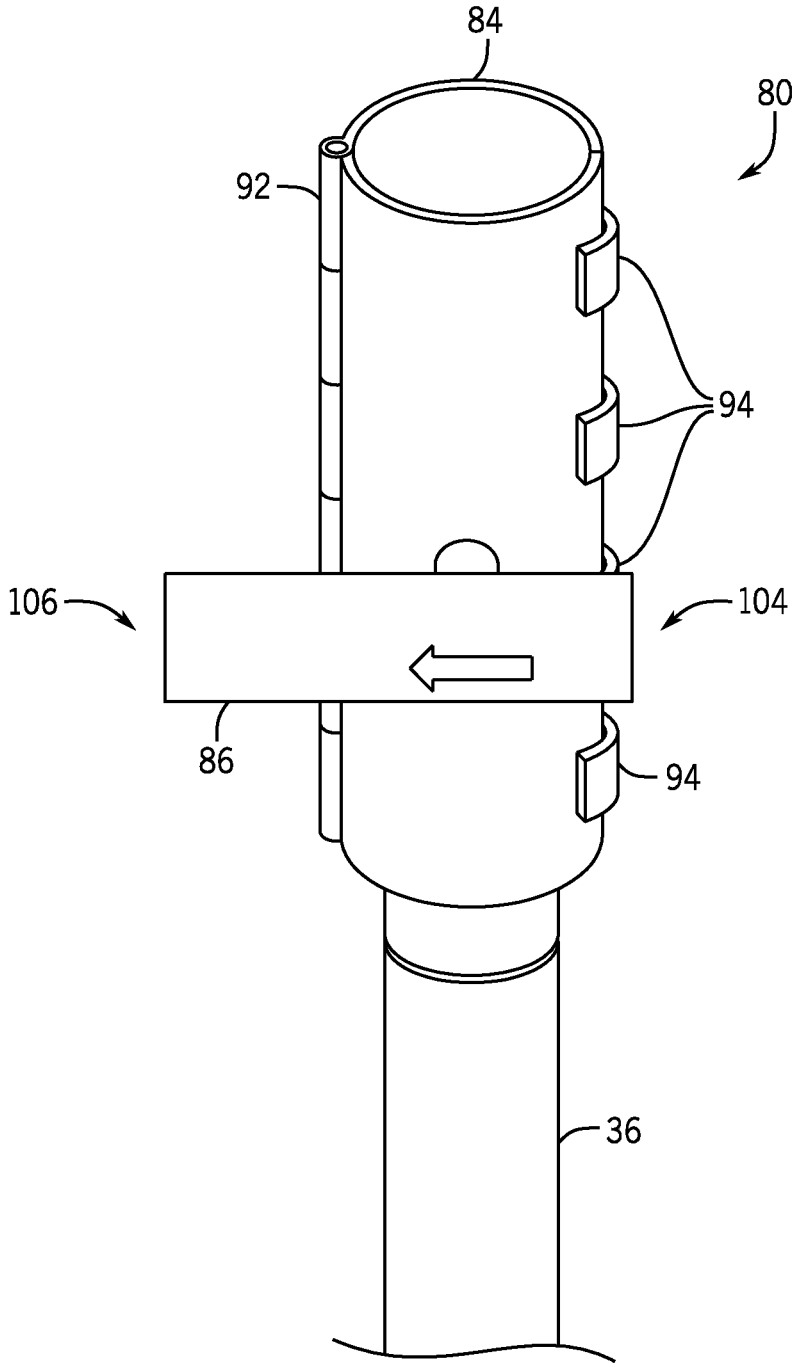
FIG. 2 is a perspective view of a drilling fluid management device coupled about a drillpipe element in accordance with present techniques.

FIG. 2 is perspective view of the drilling fluid management device 80 in accordance with present embodiments. The drilling fluid management device 80 is shown coupled about the stump 36. Specifically, the drilling fluid management device 80 is clamped over the stump 36 with a hinge 92 and may be locked into place using any of various securement mechanisms, such as a set of latches 94. As illustrated, the drilling fluid management device 80 of FIG. 2 includes the containment structure 84 and the suction port structure 86. The drilling fluid management device 80 may include any of various different sealing mechanisms to facilitate capture of drilling fluid within the containment structure 84. For example, as generally illustrated in FIG. 2, the drilling fluid management device 80 may establish a seal below where any connection or disconnection will occur (e.g., below the box end of the stump 36). In other embodiments, for example, the drilling fluid management device 80 may establish seals above and below the connection or disconnection point to facilitate the transfer of suction into the associated drillpipe elements or handling equipment (e.g., up the interior of the drillpipe 38 or into the quill 42 of the top drive 41). While present embodiments may adequately function without a substantial seal, some manner of leakage resistance will be provided. Otherwise, it will be difficult to establish a suction and at least a portion of the fluid will leak out. Thus, present embodiments include providing one or more seals between the drillpipe element or drillpipe handling equipment and the drilling fluid management device 80 such that fluid can flowing there through can be efficiently controlled.

Figure 3:
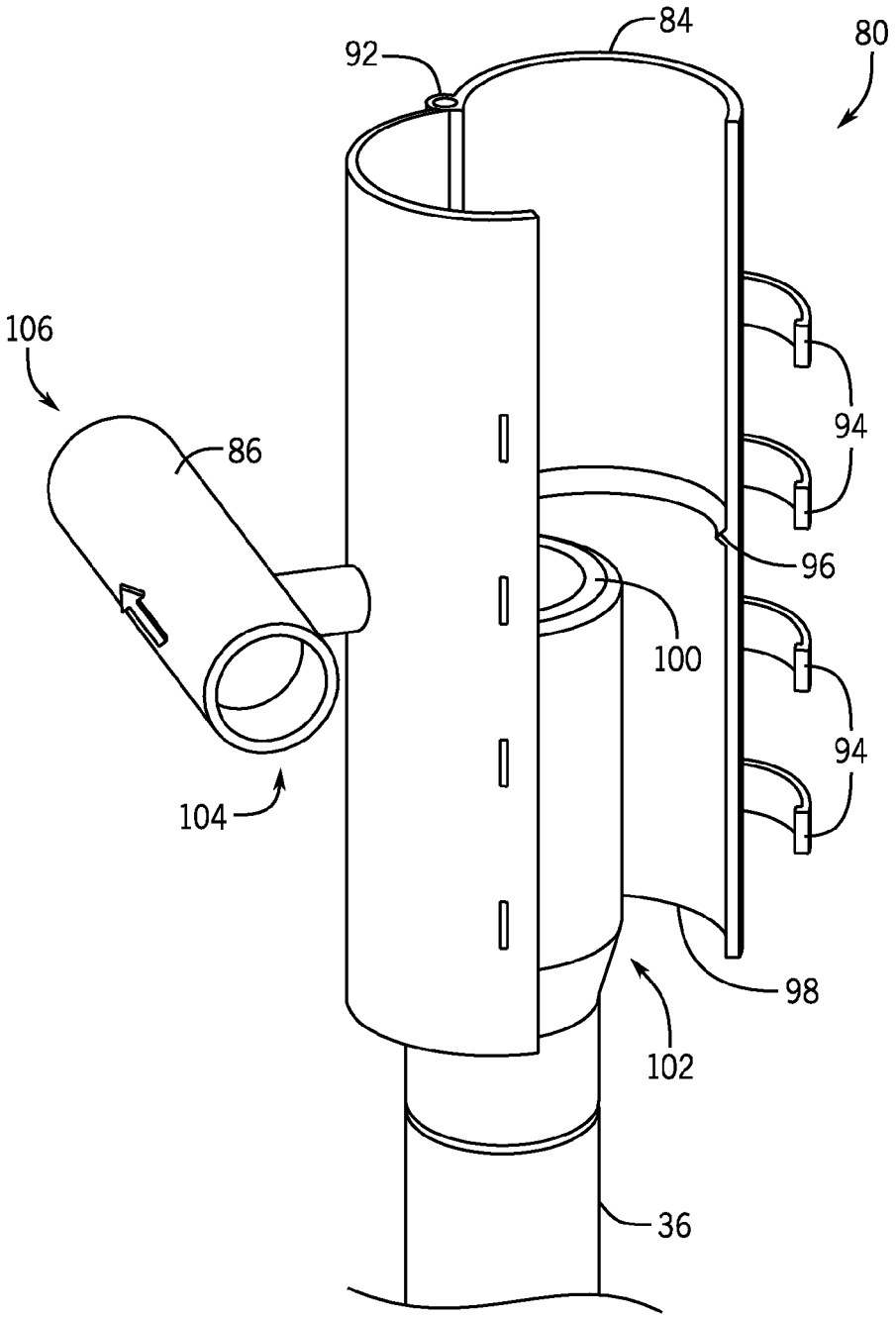
FIG. 3 is a perspective view of the drilling fluid management device of FIG. 2 being coupled about the drillpipe element in accordance with present techniques.

FIG. 3 is a perspective view of the drilling fluid management device 80 of FIG. 2 being coupled about the stump 36. As illustrated in this view, the drilling fluid management device 80 may include a positioning lip 96 and a flexible (e.g., rubber) sealing pad 98 that cooperate to establish a seal between the stump 36 and the drilling fluid management device 80 below the connector or disconnection point. In other embodiments, different types of sealing mechanisms may be used. For illustrative purposes, the embodiment of FIG. 3 includes the sealing pad 98, which may engage the outer surface of the stump 36 in a manner that leaves limited space for leakage. Further, the positioning lip 96 may ensure that the suction port is located at the sealing face between the stump 36 and the connecting drillpipe. The pad 98 or other sealing features may engage with a face 100 of a box end 102 of the stump 36 to establish a seal therewith.

The drilling fluid management device 80 is configured to be a drilling fluid or mud-catching receptacle that couples with a source of vacuum (e.g., in the sense of sub-atmospheric pressure or at least lower than the pressure inside the containment structure 84) in order to efficiently provide a draining process while containing the flow of drilling fluid from one or more coupled components (e.g., the stump 36 and the drillpipe 38). It should be noted that the embodiment illustrated in FIGS. 2 and 3 may be representative of two different styles of the drilling fluid management device 80 because the inner features of the suction port structure 86 are not visible. For example, in one embodiment, the suction port structure 86 may represent an open passage that allows fluid to pass completely there through. That is, fluid may pass from a first end 104 to a second end 106 and through a venturi component of the suction port structure 86 to generate a suction within the containment structure 84, as discussed above. Flow from the first end 104 to the second end 106 may define a main flow path of the venturi portion. Flow from the containment structure 84 into the venturi portion may be a secondary flow path established by the resulting suction.

In some embodiments, the suction port structure 86 may also be closed on the first send 104 such that a suction generating device (e.g., the suction side of a pump) can be coupled to the second end 106 and efficiently establish a suction within the containment structure 84. It should also be noted that, while the drilling fluid management device 80 is illustrated as a standalone feature, it some embodiments it is integrated with other devices. For example, the drilling fluid management device 80 may be integrated with a conveniently located device (e.g., a set of automated tongs, an iron roughneck, a differential speed disengage, or a continuous circulation quick coupler) near the top of the stump 36 at the time of connection or disconnection.

Figure 4:
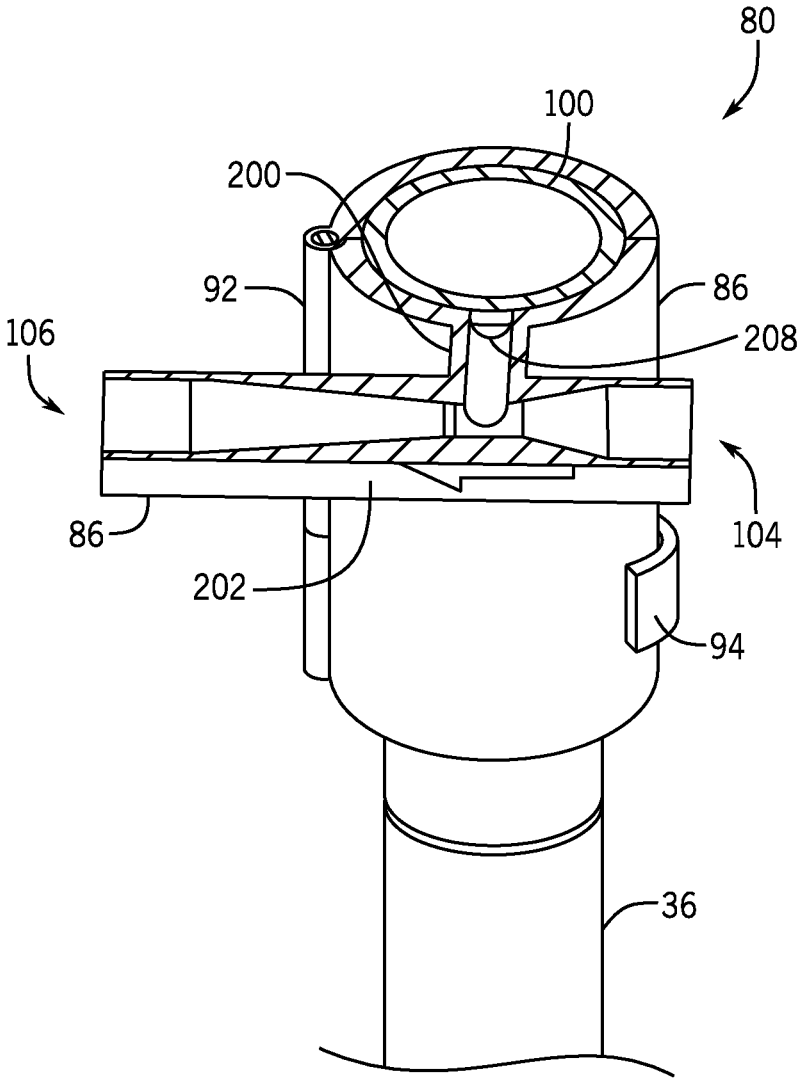
FIG. 4 is a cut-away perspective view of the drilling fluid management device of FIG. 2, wherein a suction port structure is configured for venturi-style operation in accordance with present techniques.

FIG. 4 is a cut-away perspective view of the drilling fluid management device 80 of FIG. 2, wherein the suction port structure 86 is configured for venturi-style operation in accordance with present embodiments. FIG. 4 illustrates the inner walls of the suction port structure 86 as including a suction passage 200 and a venturi portion 202. In the illustrated embodiment, the suction passage 200 and the venturi portion 202 are transverse. It should be noted that the suction passage 200 in the illustrated embodiment is generally aligned with the face 100 of the box end 102 of the stump 36. That is, an opening 208 into the containment structure 84 is substantially aligned with the face 100, which corresponds to the location at which drillpipe being disconnected will initially come apart. In this way, better flow may be established from within the containment structure 84 to the suction port structure 86 and beyond (e.g., through the conduit 90 to the retention tank 72). Similar arrangements may be defined with respect to alignment between the suction passage 200 and the face 100 in embodiments that use a suction source, such as a pump, rather than venturi-style operation.

Figure 5:
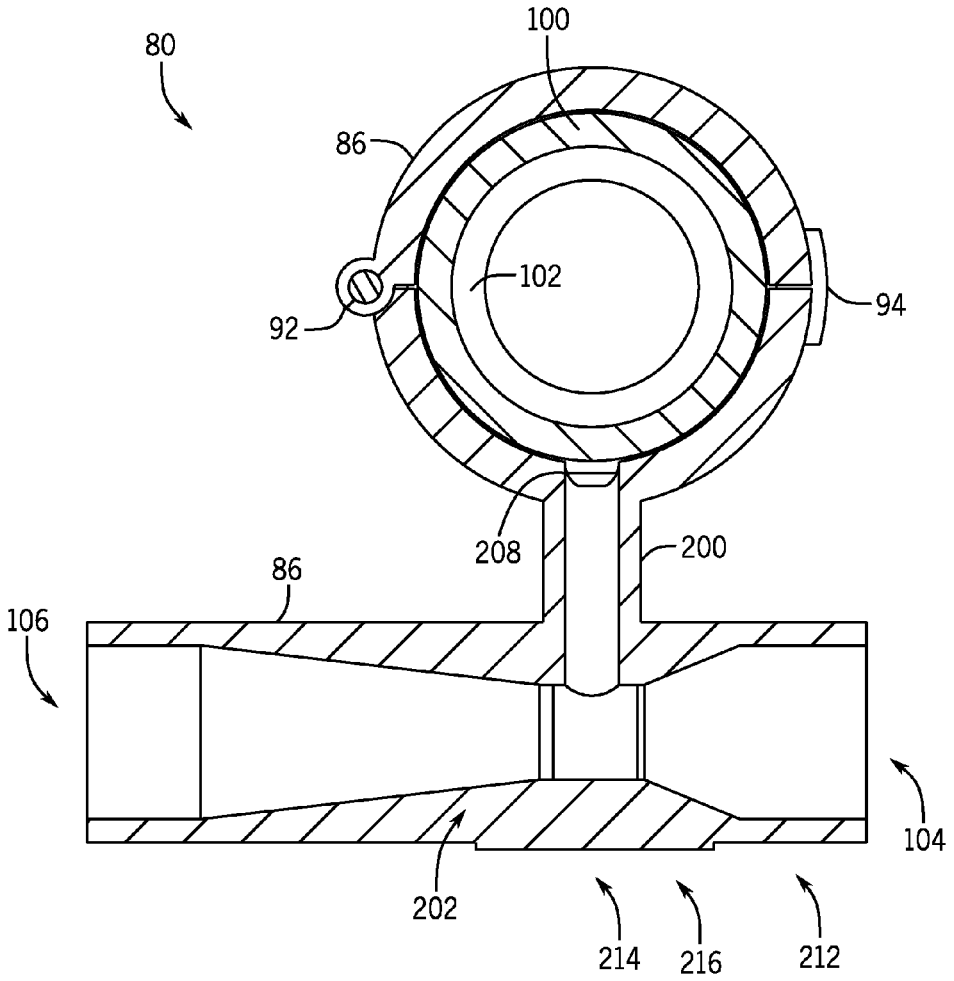
FIG. 5 is a top view of the drilling fluid management device with the cut-away illustrated in FIG. 4, wherein the suction port structure is configured for venturi-style operation in accordance with present techniques.

FIG. 5 is a top view of the drilling fluid management device 80 with the cut-away illustrated in FIG. 4, wherein the suction port structure 86 is configured for venturi-style operation in accordance with present embodiments. The walls of the venturi portion 202 of the suction port structure 86, which operates to provide the Venturi effect, are clearly illustrated in FIG. 5. The Venturi effect may be described as a reduction in pressure that occurs when a fluid flows through a constricted passage (e.g., a constricted section of pipe). When fluid flows through and constricts from a larger to a smaller diameter, this partial restriction of the flow area causes a higher pressure at the inlet than the pressure at the narrower end. This effect may be utilized in accordance with present embodiments to generate suction within the containment structure 84. Indeed, as illustrated in FIG. 5, inner walls of the suction port structure 86, in particular the venturi portion 202 of the suction portion structure 86, narrow from a broad opening 212 to a narrow passage 214 via a constriction 216. The constriction 216 is narrowest just prior to an intersection of the venturi portion 202 with the suction passage 200. This facilitates generation of suction through the suction passage 200 and into the containment structure 84. This suction may pull drilling fluid that would otherwise spill out onto a work space into the suction port structure 86 and out of the work area (e.g., down the conduit 90 to the retention tank 72). This type of arrangement may be beneficial because it utilizes drilling fluid that is easily accessible to generate the suction and does not require a separate pumping or suction system.

Figure 6:
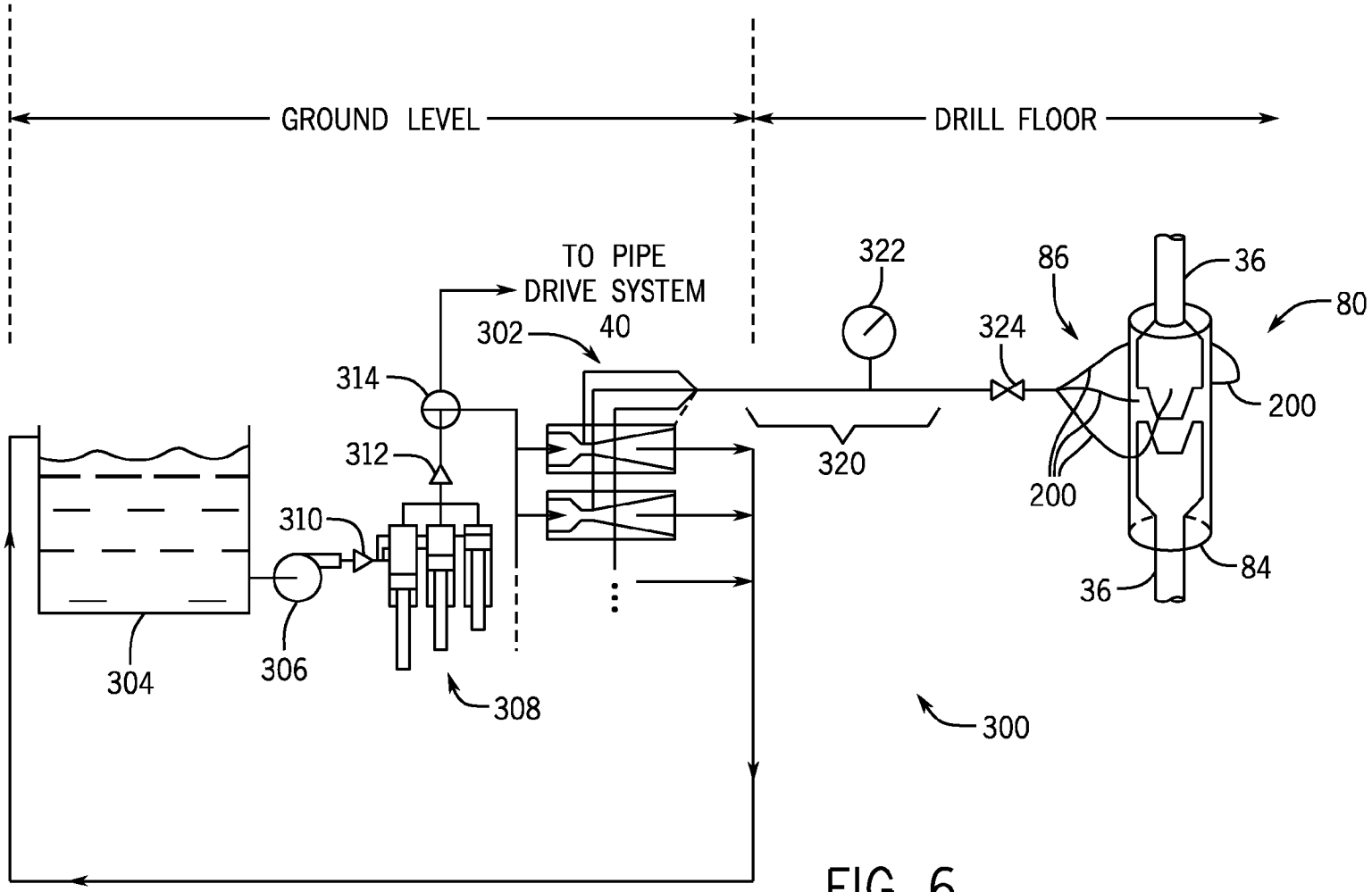
FIG. 6 is a system incorporating the drilling fluid management device with a venturi bank in accordance with present techniques.

FIG. 6 illustrates a system 300 wherein a drilling fluid management device 80 is coupled via the suction port structure 86 to a venturi bank 302, which serves as a suction source in accordance with present embodiments. Specifically, FIG. 6 illustrates the system 300 including certain components that are at ground level and certain components that are on a drilling floor level. The components of the system 300 shown at the ground level generally function to motivate drilling fluid flow through the drilling equipment and/or through the venturi bank 302 to generate suction for the drilling fluid management device 80. The components of the system 300 shown at the drilling floor level are generally related to capturing drilling fluid that might otherwise spill during certain drilling operations (e.g., decoupling drillpipe elements during continuous circulation) for return to the circulation system using conduits and the suction generated by the venturi bank 302. It should be noted that the embodiment illustrated in FIG. 6 is a specific example and that the present disclosure covers broader and different embodiments. For example, in some embodiments, different pumping systems may be utilized.

At the ground level represented in FIG. 6, a drilling fluid tank 304 provides a source of drilling fluid for charge pumps 306, which supply charged drilling fluid to high pressure positive displacement pumps 308 via check valves 310 to prevent backflow. The positive displacement pumps 308 in turn supply high pressure drilling fluid via downstream check valves 312 to the pipe drive system 40 (e.g., a Kelly hose or top drive) and/or to the venturi bank 302. Indeed, a diverter valve 314 may be actuated to allow the flow of high pressure drilling fluid from the positive displacement pumps 308 to flow to various different locations depending on the mode of operation. Specifically, in the illustrated embodiment, the diverter valve 314 is configured such that is can direct the flow of drilling fluid to only the venturi bank 302 or both the venturi bank 302 and the pipe drive system 40. It is believed that the use of multiple venturis in the venturi bank 302 along with the substantial flow that can be provided by the positive displacement pumps will provide a substantial vacuum source for removing drilling fluid from the containment structure 84.

At the drill floor level represented in FIG. 6, a suction manifold 320 communicatively couples with the multiple venturis of the venturi bank 302. Specifically, the suction manifold 320 couples with conduits that access the venturis of the venturi bank 302 proximate the associated constrictions to take advantage of the vacuum generated at these locations. The suction manifold 320 includes a vacuum gauge 322 coupled thereto for monitoring system status and a suction valve 324 that facilitates applying the vacuum generated by the venturi bank 302 to the drilling fluid management device 80 when the suction valve 324 is open or disconnecting the drilling fluid management device 80 from the vacuum when the suction valve 324 is closed. The suction manifold 320, vacuum gauge 322, and suction valve 324 may cooperate to allow an operator or control system to establish a vacuum within the suction manifold 320, as indicated by the vacuum gauge 322, before opening the valve 324 to apply suction to the containment structure 84. In some embodiments additional valves and piping may be included to provide access to a separate vacuum source, such as the suction side of a pump. Further, in some embodiments, a control system may be integrated to automate aspects of these features. The suction valve 324 couples the suction port structure 86, which does not itself include a venturi component in this embodiment. However, the suction port structure 86 of FIG. 6 does include multiple suction passages 200 that are located around the body of the containment structure 84 to increase and distribute fluid flow into the suction manifold 320 and so forth.

It should be noted that, in the embodiment illustrated by FIG. 6, the drillpipe 38 is in the process of decoupling with the stump 36. No drilling fluid is being provided to the pipe drive system 40 because the diverter valve 314 is directing all of the drilling fluid from the pumps 306, 308 to the venturi bank 302. However, the drillpipe 38 may have residual drilling fluid therein that will be flowing out through its pin end during this phase of the operation. The drilling fluid management device 80 may capture this drilling fluid exiting the drillpipe 38 in its containment structure 84, which may be sealed against the stump 36. Further, the containment structure 84 may also be at least partially sealed against the drillpipe 38 such that suction can extend up the drillpipe 38 and encourage efficient flow of the drilling fluid down into the containment structure 84. Further, the suction provided by the venturi bank 302 will pull the collected drilling fluid from within the containment structure 84 through the suction manifold 320 into the venturi bank 302 and push it along to the drilling fluid tank 304 for recirculation.

Figure 7:
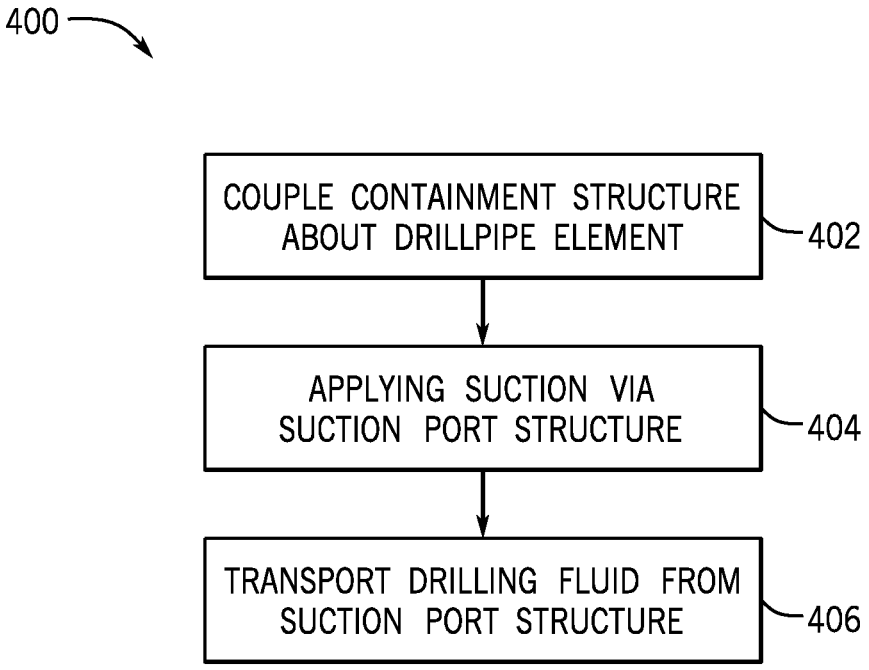
FIG. 7 is a block diagram of a method in accordance with present techniques.

FIG. 7 is a block diagram of a method 400 in accordance with present embodiments. The method includes coupling 402 a containment structure of a drilling fluid management device about a drillpipe element. This includes establishing at least a partial seal between a lower end of the containment structure and the drillpipe element below a face of an opening of the drillpipe element. For example, the sealing pad 98 may establish such a seal with an outer surface of the box end 102. However, in some embodiments, the positioning lip 96 may also establish a seal with the face 100 of the box end. The method 400 also includes applying a suction 404 within the containment structure via a suction port structure of the drilling fluid management device that includes an opening into the containment structure. This may involve establishing a Venturi effect within the suction port structure 86 using diverted drilling fluid, as generally discussed above with respect to system features. Further, the method 400 includes transporting drilling fluid 406 from within the drilling fluid management device to a drilling fluid retention tank from the suction port structure.

While only certain features have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a drilling fluid management device;

a containment structure of the drilling fluid management device configured to engage and at least partially create a seal with a drillpipe element or drillpipe handling equipment;

a suction port structure of the drilling fluid management device extending from the containment structure and including an opening into the containment structure, wherein the suction port structure is configured to couple with a drilling fluid transport feature; and a diverter valve configured to direct a drilling fluid from a pipe drive system to a venturi portion of the suction port structure.

2. The system of claim 1, wherein the suction port structure comprises a suction passage communicatively coupled to the venturi portion of the suction port structure, wherein the suction passage extends out from the containment structure and the venture portion is transverse to the suction passage.

3. The system of claim 2, wherein inner walls of the venturi portion of the suction port structure narrow from a broad opening to a narrow passage via a constriction.

4. The system of claim 3, wherein the suction passage and the venturi portion intersect proximate the narrow passage.

5. The system of claim 3, comprising a drilling fluid supply coupled to a first end of the venturi portion via a conduit such that the system is configured to flow drilling fluid from the first end to a second end and such that the narrow passage is downstream of the broad opening with respect to the flow.

6. The system of claim 5, wherein the suction passage and the venturi portion intersect at least partially downstream of the constriction.

7. The system of claim 1, wherein the opening is arranged to align with a face of the drillpipe element or drillpipe handling equipment.

8. The system of claim 1, comprising a suction side of a pump coupled with the suction port structure.

9. The system of claim 1, comprising a positioning lip extending at least partially around an inner perimeter of the containment structure and configured to align with a face of a drillpipe when the containment structure is engaged about the drillpipe.

10. The system of claim 1, comprising a sealing pad extending around a portion of an inner surface of the containment structure and configured to establish a sealed engagement with a surface of the drillpipe element or the drillpipe handing equipment when the containment structure is engaged about the drillpipe element or the drillpipe handling equipment.

11. The system of claim 1, comprising a drillpipe, wherein the containment structure is sealed about a box end of the drillpipe via engagement between a sealing pad of the containment structure and an outer surface of the box end.

12. The system of claim 1, comprising a pair of drillpipes coupled together, wherein the containment structure is sealed about a box end of a first of the pair of drillpipes and a pin end of a second of the pair of drillpipes such that the opening is aligned with a face of the box end of the first of the pair of drillpipes.

13. The system of claim 1, comprising a venturi bank communicatively coupled with the suction port structure, wherein the suction port structure comprises a suction passage including a plurality of flow paths communicatively coupled with the containment structure.

14. The system of claim 13, comprising a suction manifold operating as the drilling fluid transport feature and coupling the venturi bank with the suction port structure.

15. A method, comprising:

coupling a containment structure of a drilling fluid management device about a drillpipe element such that at least a partial seal is established between a lower end of the containment structure and the drillpipe element below a face of an opening of the drillpipe element;

applying a suction within the containment structure via a suction port structure of the drilling fluid management device that includes an opening into the containment structure;

transporting drilling fluid from within the drilling fluid management device to a drilling fluid retention tank from the suction port structure; and operating a diverting valve to direct the drilling fluid from a pipe drive system to the suction port structure.

16. The method of claim 15, wherein applying the suction comprises generating a Venturi effect within the suction port by passing drilling fluid from one end of a venturi portion of the suction port structure to a second end of the venturi portion of the suction port structure.

17. The method of claim 16, comprising operating the diverting valve to direct the drilling fluid from the pipe drive system to the venturi portion of the suction port structure.

18. The method of claim 15, wherein applying the suction comprises generating a suction with a venturi bank comprising a plurality of venturis communicatively coupled with the suction port structure.

19. A system, comprising:

a drillpipe element;

a drilling fluid management device;

a containment structure of the drilling fluid management device coupled about the drillpipe element;

a suction port structure coupled with the containment structure and including an opening into the containment structure;

a suction manifold communicatively coupled with the suction port structure and including a valve configured to seal the suction manifold away from the suction port structure;

a venturi bank including a plurality of venturis communicatively coupled with the suction manifold along a main flow path of each venturi and down stream of a constriction in each venturi; and a drilling fluid pumping system configured to pump drilling fluid through the main flow path of each venturi.

* * * * *